US006385930B1

(12) United States Patent
Broms et al.

(10) Patent No.: US 6,385,930 B1
(45) Date of Patent: May 14, 2002

(54) CONCRETE STRUCTURE AND METHOD OF MAKING IT

(76) Inventors: Carl-Erik Broms, Flyghamnsvägen 18, S-183 64 Täby; Kent Arvidsson, Grev Magnigatan 14, S-114 55 Stockholm, both of (SE)

( * ) Notice: Subject to any disclaimer, the term of this patent is extended or adjusted under 35 U.S.C. 154(b) by 0 days.

(21) Appl. No.: 09/613,169

(22) Filed: Jul. 10, 2000

(30) Foreign Application Priority Data

Jul. 16, 1999 (SE) ..... 9902722

(51) Int. Cl.[7] ..... E04B 1/04

(52) U.S. Cl. ..... 52/251; 52/250; 52/223.6; 52/649.1; 52/742.14; 52/677

(58) Field of Search ..... 52/742.14, 677, 52/649.1, 260, 259, 253, 252, 251, 414, 649.2; 264/31, 35, 228; 249/207, 213, 218

(56) References Cited

U.S. PATENT DOCUMENTS 4,333,285 A * 6/1982 Koizumi et al. ..... 52/252
4,406,103 A 9/1983 Ghali
5,181,359 A * 1/1993 Chana et al. ..... 52/253
5,809,712 A * 9/1998 Simanjuntak ..... 52/223.7
6,003,281 A * 12/1999 Pilakoutas ..... 52/742.14

OTHER PUBLICATIONS

Broms, Carl–Erik "Shear Reinforcement for Deflection Ductility of Flat Plates" ACI Structural Journal V.87, No. 6 Nov.–Dec. 1990, pp. 676–705.

Broms, Carl–Erik "Punching of Flat Plates" ACI Structural Journal V.87, No. 3 May–Jun. 1990, pp. 292–304.

* cited by examiner

*Primary Examiner*—Carl D. Friedman
*Assistant Examiner*—Jennifer I. Thissell
(74) *Attorney, Agent, or Firm*—Timothy Platt

(57) ABSTRACT

A novel and simple method of making a novel concrete slab structure supported on vertical columns (1) and having high strength against punching shear failure involves: placing stirrup cages (3, 3') with their open sides downwards directly on top of the bottom reinforcement net (7) in a form; laying, crossed bent bars (8) over the top of the column and running along the bottom reinforcement net (7); laying a top reinforcement net (7') on top of the stirrup cages (3,3') and the crossed bent bars (8); pouring concrete into the form to a level above the top reinforcement net (7').

7 Claims, 8 Drawing Sheets

CONCRETE STRUCTURE AND METHOD OF MAKING IT

The present invention relates to a novel structure for column supported concrete slabs in accordance with the preamble to the attached Claim 1 and to a method for making such structures in accordance with the preamble to the attached Claim 5.

The flat plate is a very common and commercially competitive structural system for cast-in-place slabs in buildings, since no beams, column capitals or drop panels, i.e. thickened portions around columns, are involved, thus making the formwork extremely simple. The structural concept is at a great disadvantage, however, because of the risk of brittle punching failure at the slab-column connection. Extensive research efforts have therefore been devoted—and are still being devoted—to the development of methods for reliably predicting punching shear capacity.

Modern building codes require that a structure be designed in such a way "that it will not be damaged by events like explosions, impact or consequences of human errors, to an extent disproportionate to the original cause". (European Committee for Standardization, Eurocode 2, Design of Concrete Structures, Part 1: General Rules and Rules for Buildings, ENV 1992-1-1:1991). In other words: a local failure must not lead to progressive collapse of the entire structure. Attention has been directed to fulfilling this requirement in the case of flat plates, i.e. preventing a punching failure at one column, due to a gas explosion for example, from leading to subsequent punching at adjacent columns due to large slab rotations, and possible progressive collapse.

These problems and possible solutions were addressed in several scientific publications by the present inventor: Broms, Carl Erik, "Punching of Flat Plates—A Question of Concrete Properties in Biaxial Compression and Size Effect", ACI Structural Journal, V. 87, No. 3, May–June 1990, pp. 292–304 and "Shear Reinforcement for Deflection Ductility of Flat Plates," ACI Structural Journal, V. 87, No. 6, November–December 1990, pp. 696–705. In this latter article, it was pointed out the necessity of designing and arranging the reinforcement for flat plates so that a ductile failure mode is guaranteed. To achieve this, the article proposed the use of inter alia two pairs of bent bars laid at right angles to each other over the column end. The bent bars follow a bottom flexural reinforcement net adjacent the bottom surface of the flat plate, except at the columns where they slant upwards and follow the top flexural reinforcement net adjacent the top surface of the flat plate. The solution suggested in the latter ACI Structural Journal article also incorporates a stirrup cage unit, comprising several rows of U-shaped spaced bars, connected by longitudinally extending parallel bars. This previously known stirrup cage unit is shown in FIG. 8. The bottom flexural reinforcement net is placed on top of the stirrup cage arrangement, which is placed in the form first. This locks the stirrup cage arrangement in place in accordance with established practice. The bent bars are then put in place, whereupon the top flexural reinforcement net is put in place and the concrete is poured.

Solutions for preventing punching shear must come from an understanding of the basic principles of the failure mechanism.

Most concrete codes define the punching capacity in terms of nominal shear stress acting on a vertical surface a certain distance away from the column. That approach is unfortunate since it incorrectly implies that the punching capacity is governed by the diagonal tensile strength of the concrete slab. In fact diagonal cracks normally develop already at a load level on the order of ½ to ⅔ of the ultimate load. These cracks can completely surround the column, the slab is still stable and can be unloaded and reloaded several times at that load level without any decrease of the ultimate capacity.

The punching failure occurs instead when the concrete in compression at the bottom of the slab near the column is distressed by the high tangential "squeezing" due to the global flexural curvature. At columns with small diameter, the inclined compression stress in the radial direction below the shear crack may govern.

The failure mechanism described above clarifies why stirrups or stud rails generally do not result in the desired ductile behavior. For such shear reinforcement, a capacity increase—as well as some ductility increase—is normally encountered in relation to a flat plate without shear reinforcement, but the failure mode is still a sudden punching failure.

If the stirrups or studs extend far enough from the column to prevent a shear failure outside the shear reinforcement, typically a steep shear crack forms near the column passing between the stirrups (studs) at failure. This occurs because the distressed compressed concrete near the column becomes too soft when the tangential strain reaches a critical level—a scenario that differs from beams and one-way slabs where tangential compression does not occur.

The detrimental effect on the tensile capacity of the concrete in perpendicular direction to the tangential compression is demonstrated if the shear reinforcement is not extended far enough from the column. Then a diagonal tension failure will ultimately develop outside the shear reinforcement. Once the diagonal crack opens up it will immediately propagate within the soft concrete cover under the shear reinforcement all the way up to the column.

The solution presented in the latter ACI Structural Journal article discussed above, has however not been readily adopted by builders despite advantages shown, due to the extra steps involved in interlacing the bottom reinforcement net on top of the trough bottoms of the stirrup cage unit, thereby anchoring the stirrup cage unit in place in accordance with accepted practice.

One proposed method is described inter alia in U.S. Pat. No. 4 406 103 (Ghali et al.) which deals with the reinforcement of concrete slabs in the vicinity of columns and suggests the use of a line of spaced vertical members in the form of thin I-beam sections or rods welded to a base or horizontal longitudinal rod. These proposed means are difficult, time-consuming and thus costly to construct. They do not provide the ductility required to prevent punching under extreme loads, as dictated by the analysis above.

Prevailing knowledge, including the US patent referred to above, has dictated that the bottom flexural reinforcement net must be placed on top of parts of the stirrup cages to anchor them. This has made the implementation of the solutions proposed in the present inventor's November–December 1990 article in ACI Structural Journal (discussed above) more difficult.

These problems are solved by a concrete flat slab structure supported horizontally on at least one substantially vertical column, said slab structure having a body of cast concrete with a bottom surface and a top surface opposite thereto, a bottom flexural reinforcement net embedded in said body adjacent the bottom surface, a top flexural reinforcement net embedded in said body adjacent the top surface, and, in an area immediately surrounding each column, a stirrup cage arrangement made up of vertically oriented U-shaped bars interconnected in spaced relationship by longitudinally extending horizontal bars, as well as two or more bent bars laid substantially at right angles to each other over the column end, each of said bent bars running substantially along said bottom flexural reinforcement net except at the columns where the bent bars run substantially along said top flexural reinforcement net, characterized in that the longitudinally extending horizontal bars of the stirrup cage arrangement are disposed in a non-interlocking manner on top of the bottom flexural reinforcement net and that said top flexural reinforcement net is disposed in a non-interlocking manner on top of the stirrup cage arrangement; and by a method of building a concrete slab structure supported horizontally on at least one substantially vertical column, said method comprising the following steps of:

a. laying in a form a bottom flexural reinforcement net;

b. placing, in areas adjacent each column on either side thereof, in parallel rows, long stirrup cages, each composed of a series of vertically oriented U-shaped bars connected, in spaced relationship with each other, by two longitudinally extending bars fixed to the ends of the legs of each U-shaped bar;

c. laying, at right angles to each other and crossing each other at the respective column, at least two bent bars, in such a way that each of said bars runs substantially along said bottom flexural reinforcement except at the columns;

d. laying, on top of said stirrup cages and said bent bars, a top flexural reinforcement net;

e. pouring concrete in said form to a level above said top flexural reinforcement net and allowing it to set.

The invention will now be described with reference to an illustrative example in connection with the accompanying figures of which:

FIG. 1 shows a plan view of a flat plate mounted on at least four columns,

FIG. 2 shows a cut-off view of a single-row stirrup cage for use in the construction and method according to the invention, FIGS. 3–7(*a* and *b*, respectively) show in side view and plan view respectively the sequential steps of one embodiment of the method according to the invention, FIG. 8 shows the reinforcements in a flat plate in accordance with the recommendations in the inventor's article in ACI Structural Journal, V. 87. No. 6, November–December 1990, pp.696–705 (background art).

Figure 1:
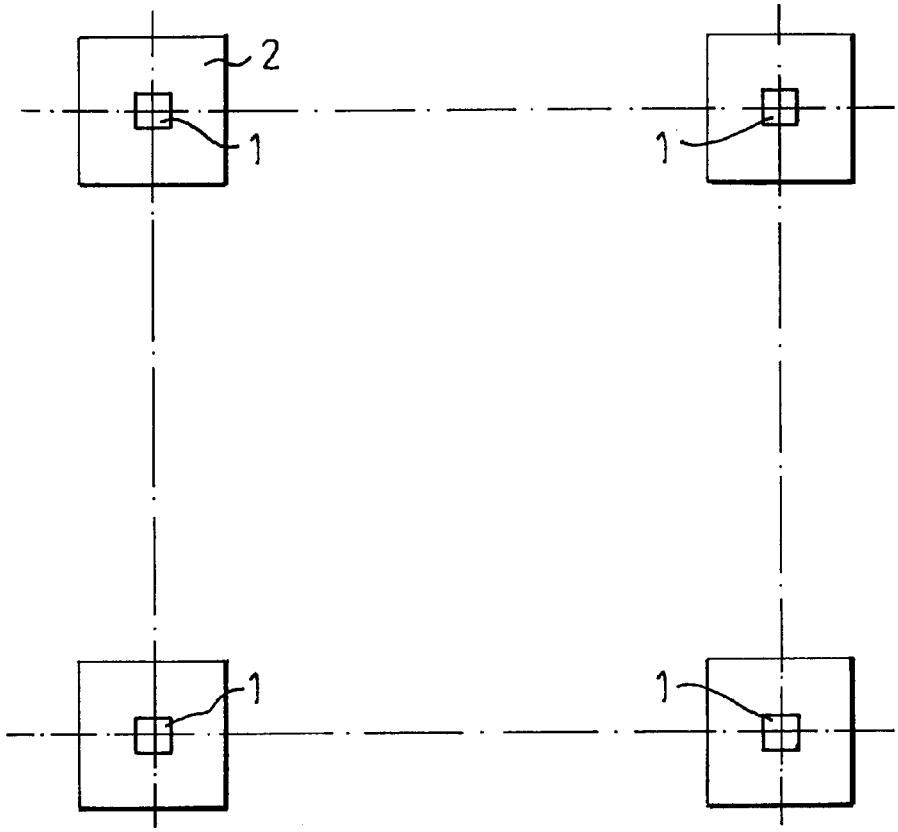

FIG. 1 shows a plan view of a typical flat plate supported by a plurality of columns 1, four of which are shown here. In such flat plate constructions, the area 2 surrounding each column should be supplementarily reinforced to prevent the column from punching through the plate under extreme load, such as during an explosion, or an earthquake. This area has often been reinforced with stirrup cages. The dimension of the area is approximately ¼ of the distance between two columns.

Figure 2:
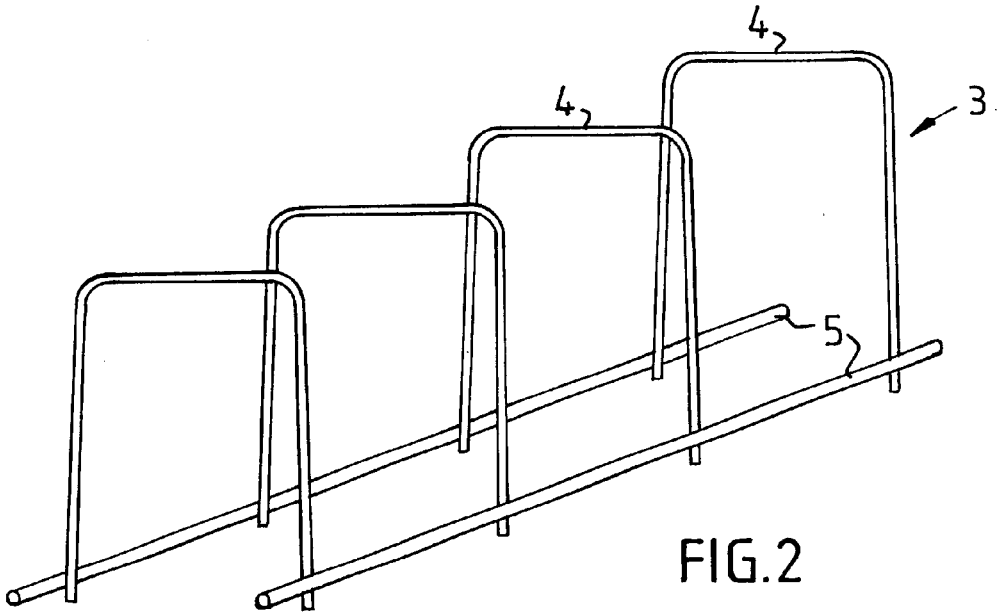

FIG. 2 shows a portion of a single-row stirrup cage, which is known per se. It consists of spaced U-shaped steel rods 4 interconnected in spaced relationship by longitudinally extending rods 5 welded to the ends of the legs of the U-shaped rods 4.

Figure 3A:
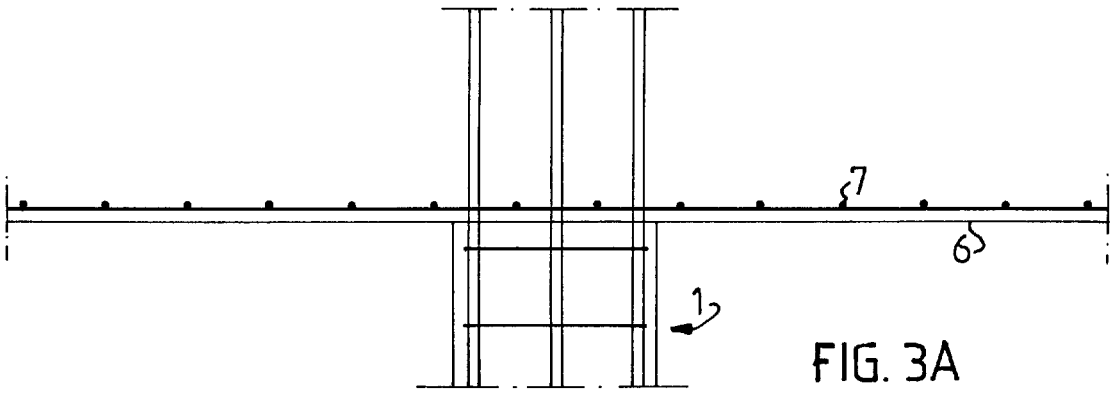
Figure 3B:
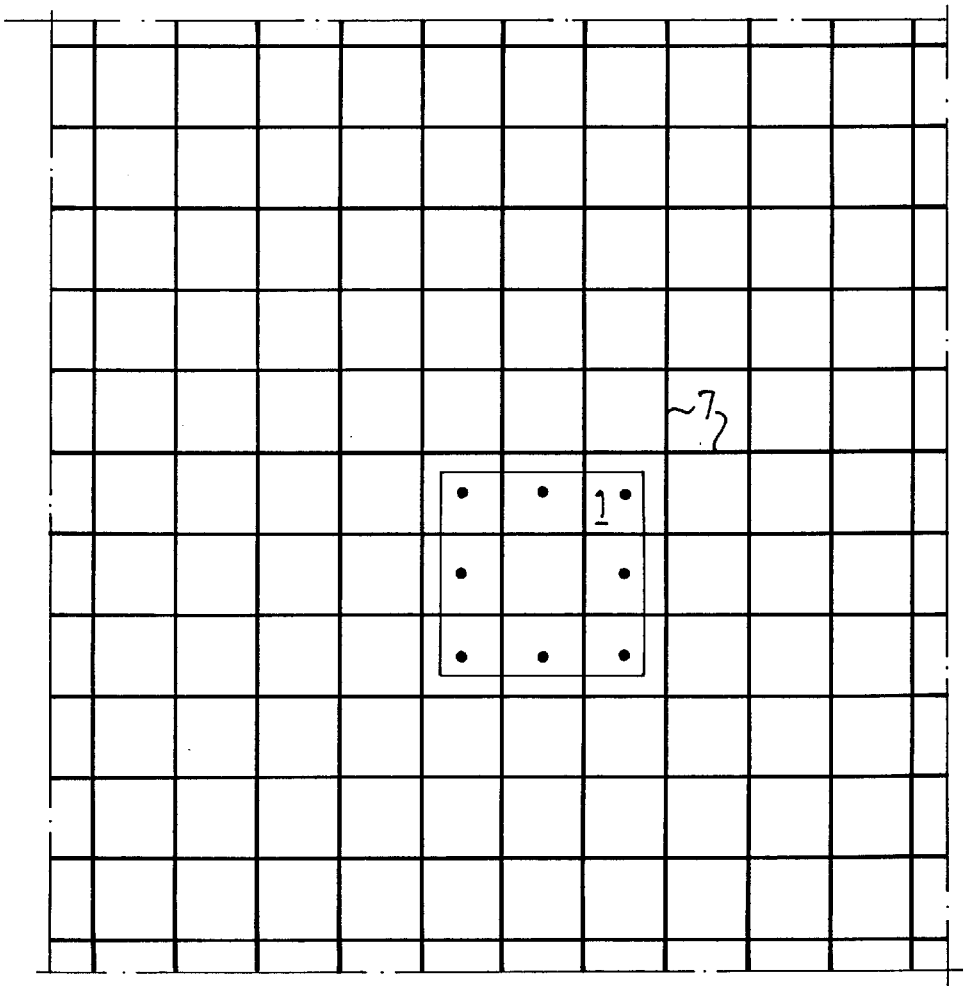

FIGS. 3*a*+*b* through 7*a*+*b* show the sequential steps of the method according to the invention. FIG. 3*a* shows in a side view and FIG. 3*b* shows in plan view the construction after the first step has been completed. A plywood form 6 has been previously mounted at the end of a column 1 and a net 7 of flexural reinforcement rods is placed slightly above the bottom of the plywood form. This flexural reinforcement net 7 can either be a factory welded net or can be tied in situ of individual rods. The mesh size usually ranges from 100 to 200 mm.

Figure 4A:
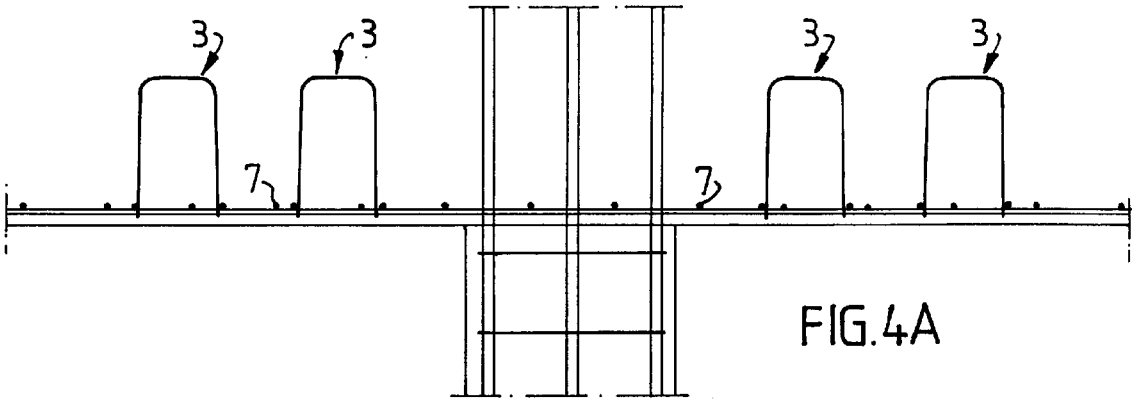
Figure 4B:
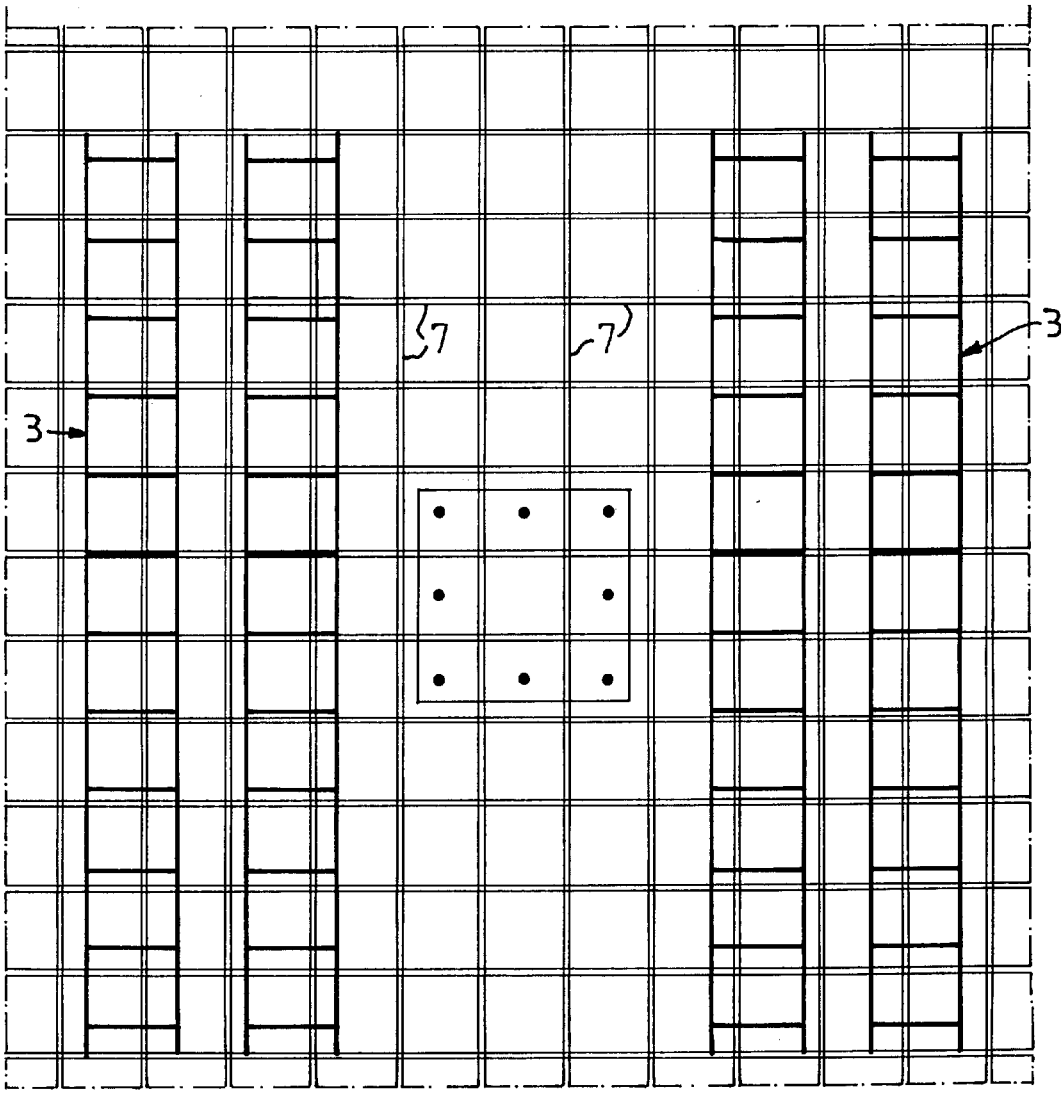
Figure 8:
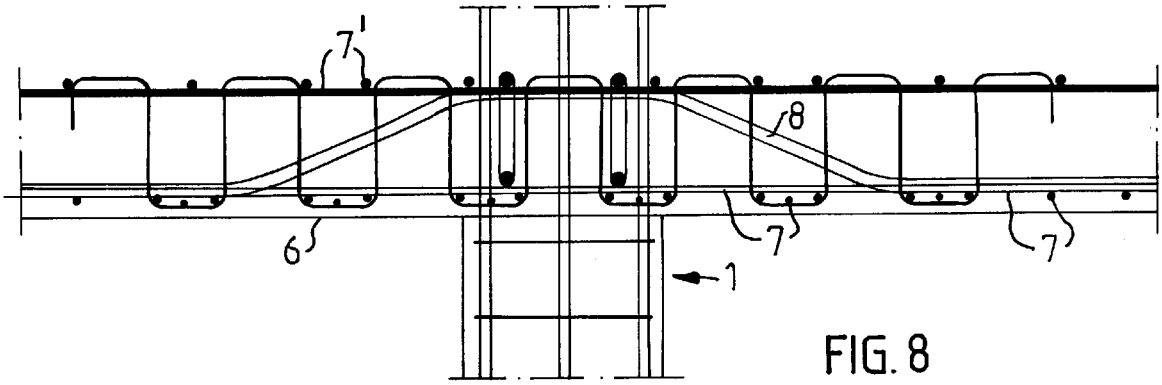
Figure 9:
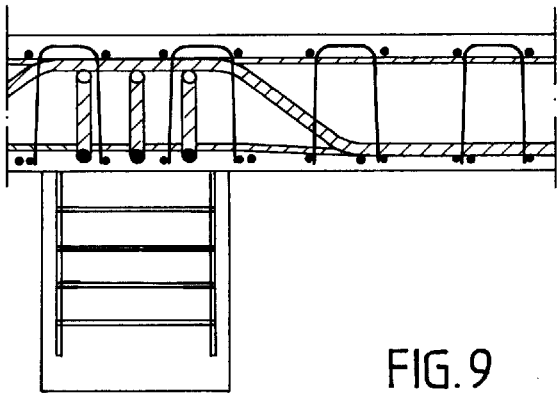
FIG. 9 shows a configuration of a comparative test slab.

FIGS. 4*a* and 4*b* show in side and plan views respectively the construction after completion of the second step of the method according to the invention, i.e. the placement and tying in place of long single-row stirrup cages 3, which are known per se. In contrast to usual practice, these stirrup cages are simply placed with their opening facing downward and with their longitudinal connecting rods resting on the bottom bars of the bottom flexural reinforcement 7 and then tied in place. This step is particularly simple for the builder, in contrast to the case where the bottom flexural reinforcement net is placed on top of the longitudinal bottom rods of the stirrup cages, as shown in FIGS. 8 and 9 in accordance with accepted expert practice in the field. The constructions shown in FIGS. 8 and 9 are particularly complicated since the bottom flexural reinforcement net extends over the entire bottom surface of the flat plate and not just in the vicinity of the columns.

The stirrup cages used in the arrangement shown in FIG. 8 are multi-row cages with a single cage extending across the entire width of the area 2 surrounding each column. FIG. 9 shows single-row stirrup cages such as those shown in FIG. 2 and which are used in accordance with the present invention but which, in this case, are placed in the form first with the bottom reinforcement placed on top of it, thus trapping the longitudinally extending rods of the stirrup cages beneath the bottom flexural reinforcement, in accordance with conventional wisdom.

Figure 5A:
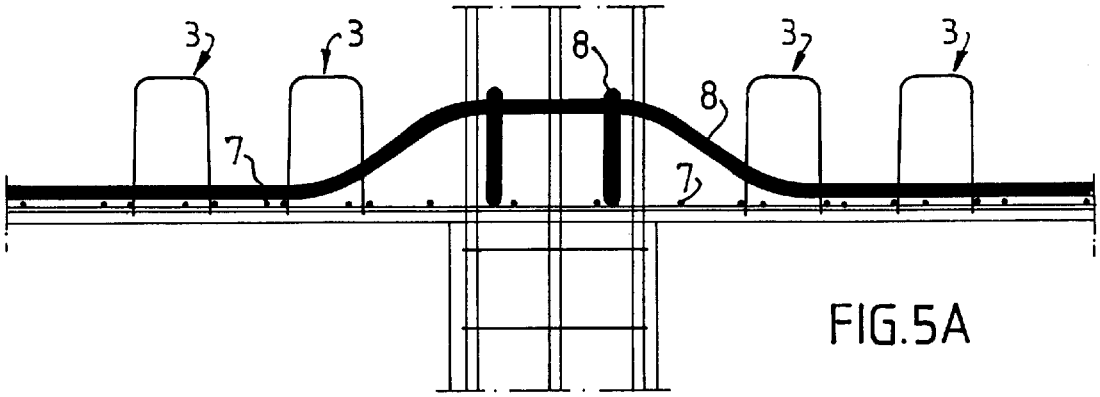
Figure 5B:
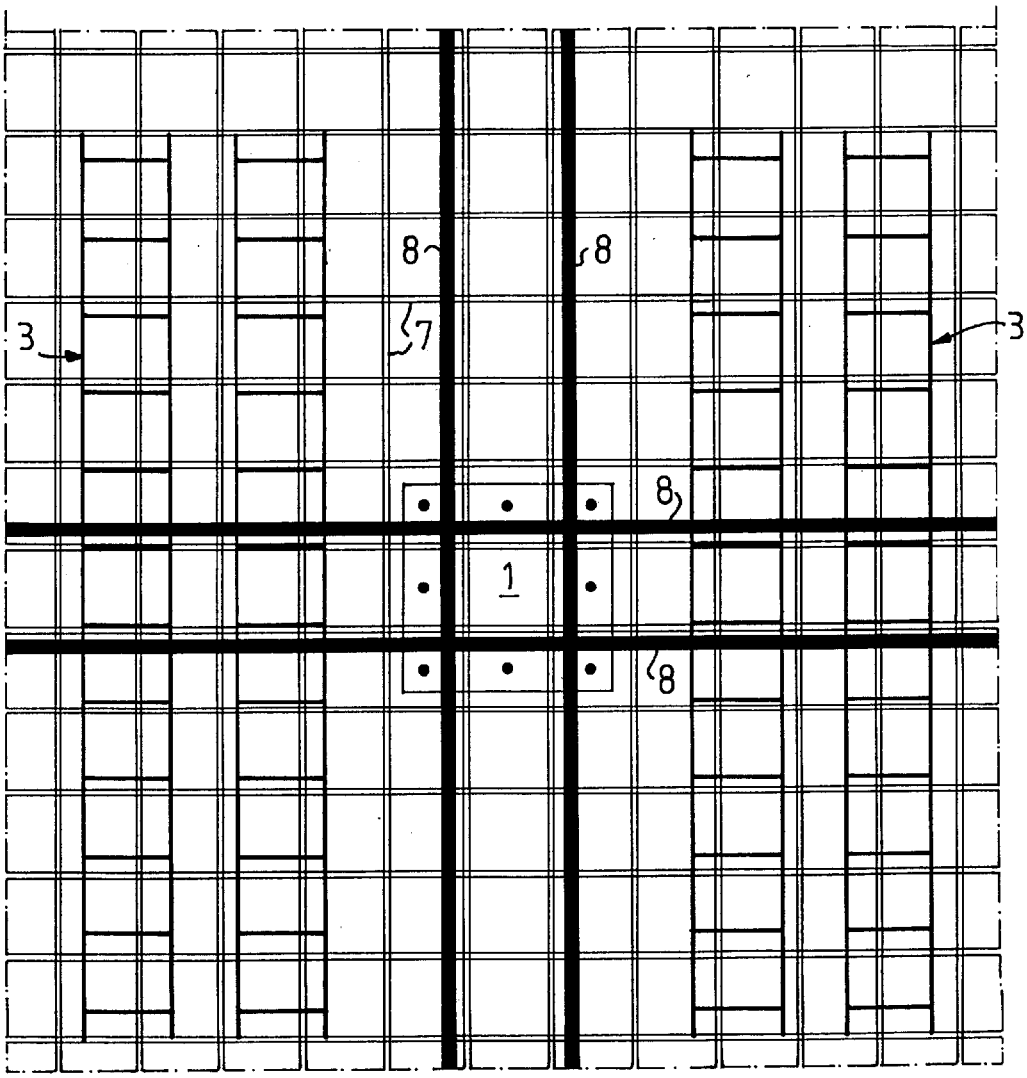

FIGS. 5*a* and 5*b* show in side view and in plan view respectively the appearance of the construction according to the invention after the placement of the bent bars 8 laid at right angles to each other and crossing each other at the respective column in such a way that each of said bars runs substantially along said bottom flexural reinforcement except at the columns where the bent bars run at the level of the top flexural reinforcement net to be placed on top. In the embodiment shown, two pairs of parallel bent bars cross each other at the column, but it is equally possible to use single crossed bars or more than two in each direction within the scope of the present invention.

Figure 6A:
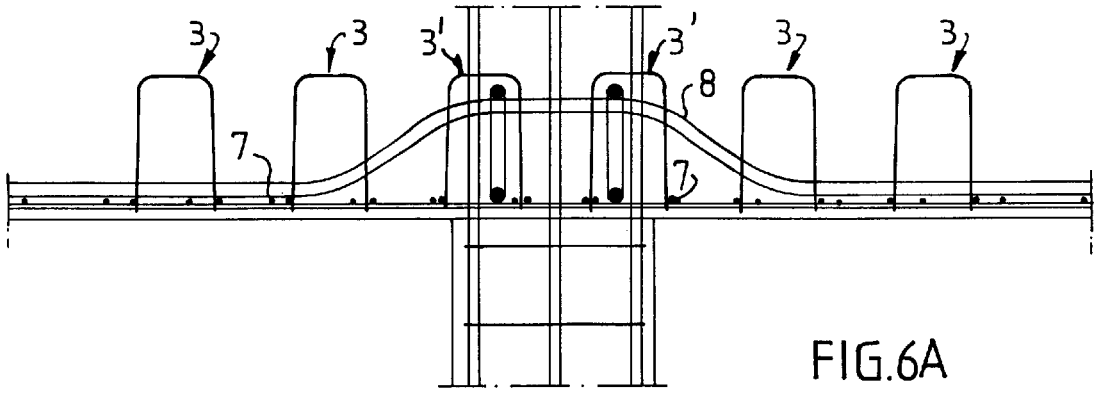
Figure 6B:
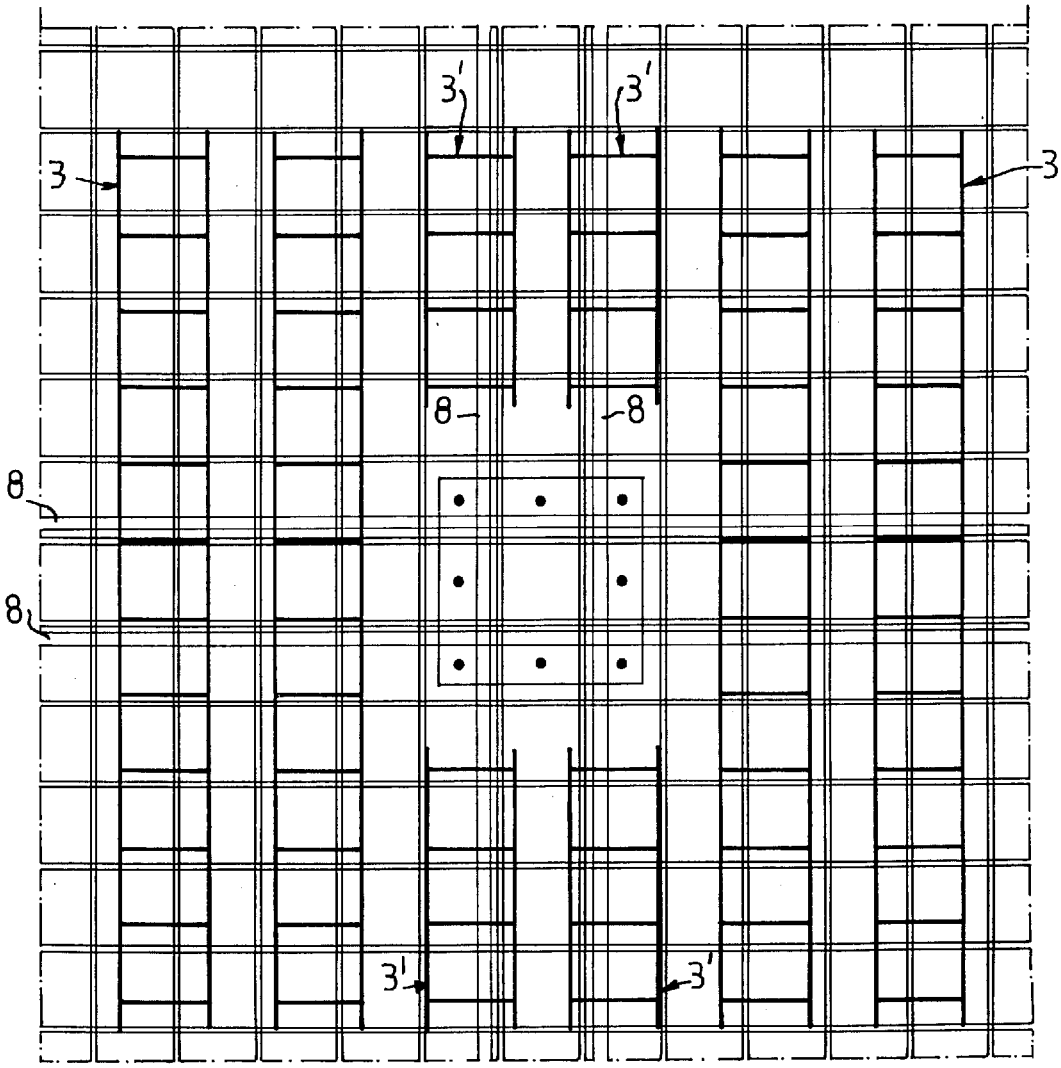

FIGS. 6*a* and 6*b* show the step of placing short stirrup cages 3' running up to the column parallel to the long stirrup cages. This step is part of one variant of the invention.

Figure 7A:
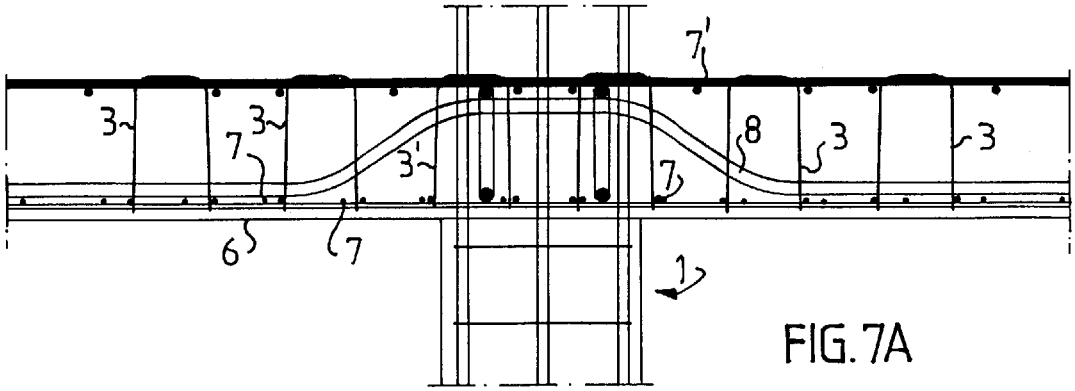
Figure 7B:
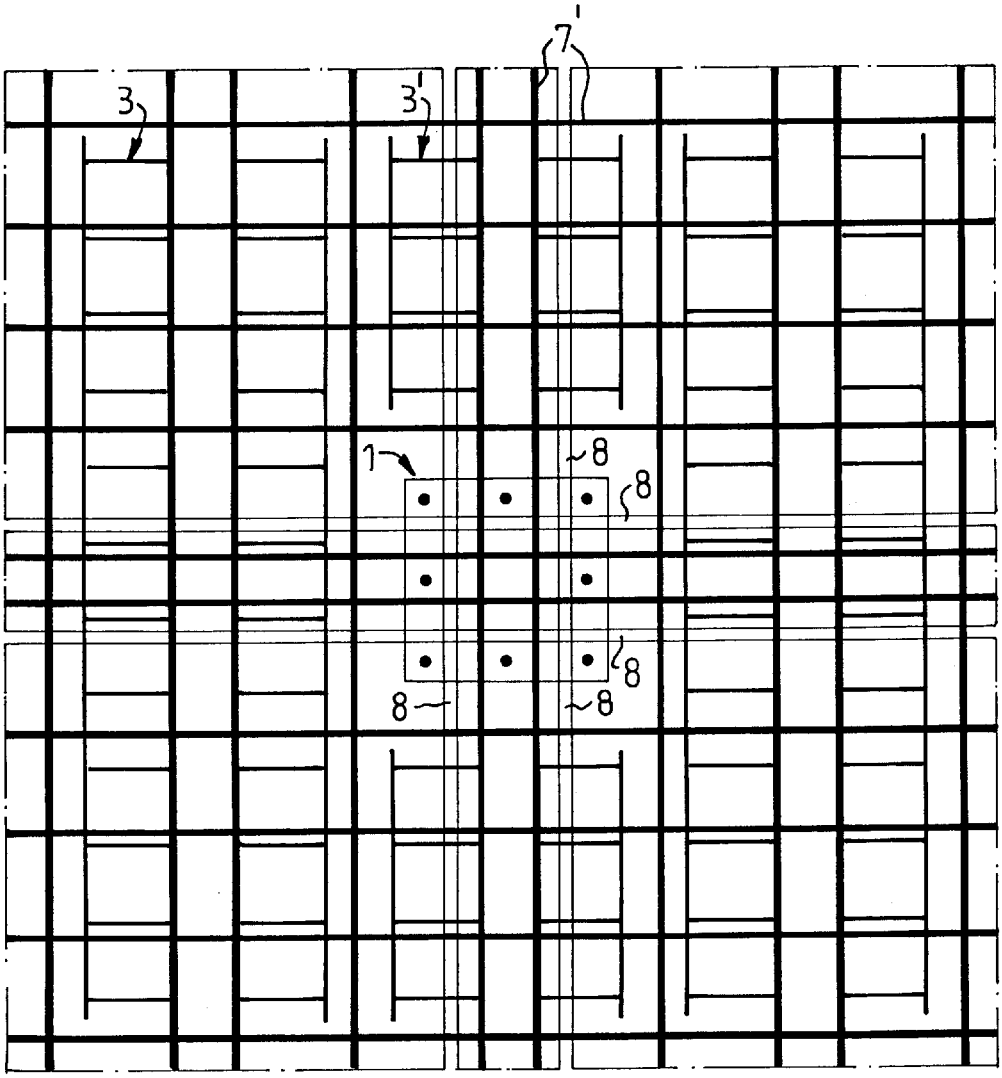

FIGS. 7*a* and 7*b* then show the construction when the step of placing the top flexural reinforcement net 7' on top of the bent bars and stirrup cages.

The concrete is then poured in to a level slightly above the top reinforcement net to cover all the reinforcing rods in the flat plate.

Figure 10:
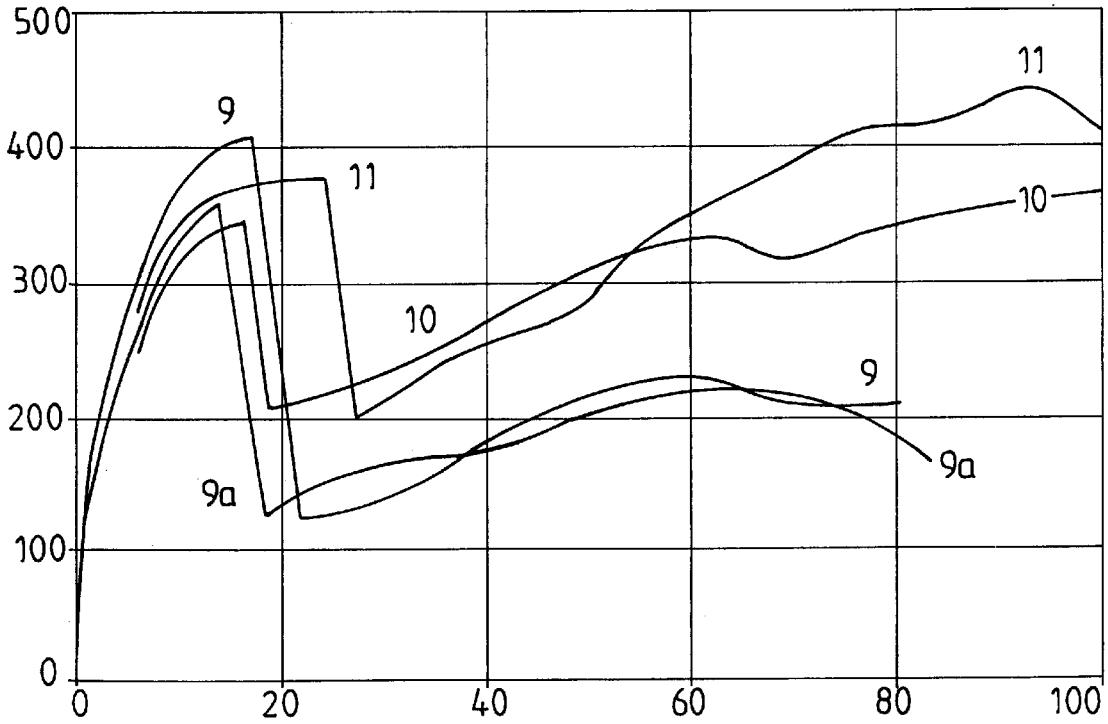
FIG. 10 is a diagram showing test results (failure) for certain test slabs.

FIG. 10 is a diagram showing the failure through punching of certain test slabs. specimens 9, 9*a*, 10 and 11. Specimens 9 and 9*a* contained no shear reinforcement at all and failed quite rapidly. Specimens 10 and 11 had 12-mm bent bars but no stirrup cages. These specimens failed as well.

Figure 11:
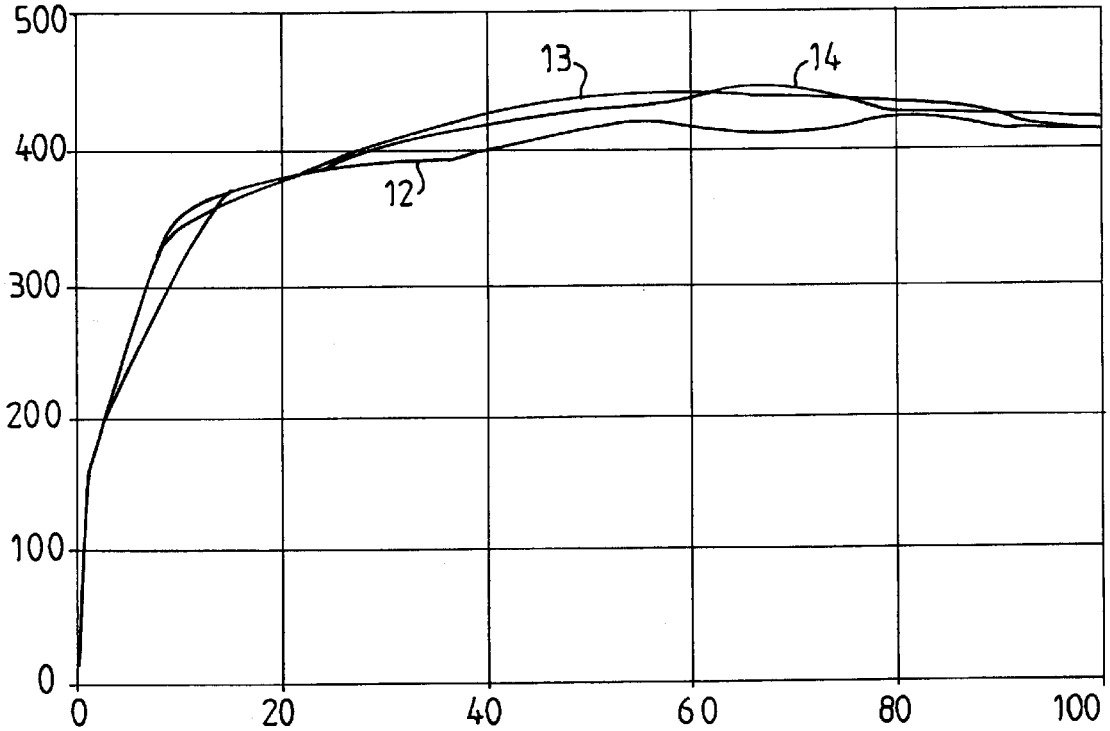
FIG. 11 is a diagram showing test results (no punching) for certain test slabs according to the present invention and another comparative test slab.

FIG. 11 is a diagram showing the successful test results (no punching) for the test slabs, specimens 13 and 14 made in accordance with the present invention and for a comparative test slab, specimen 12 made as shown in FIG. 9 in accordance with conventional wisdom, that is to say first placing the stirrup cages in the form and then placing the bottom flexural reinforcement net on top of the stirrup cages thus locking the longitudinal bars 5 of the stirrup cages 3 under the bottom flexural reinforcement.

Surprisingly, when the individual stirrup cages 3 were placed in the form after the bottom flexural reinforcement 7, i.e. made much more simply and easily in accordance with the present invention, disregarding conventional wisdom, these specimens 13 and 14 performed just as well as specimen 12.

What is claimed is:

1. Concrete flat slab structure supported horizontally on at least one substantially vertical column (1), said slab structure having a body of cast concrete with a bottom surface and a top surface opposite thereto, a bottom flexural reinforcement net (7) embedded in said body adjacent the bottom surface, a top flexural reinforcement net (7') embedded in said body adjacent the top surface, and, in an area immediately surrounding each column, a stirrup cage arrangement (3, 3') made up of vertically oriented U-shaped bars (4) interconnected in spaced relationship by longitudinally extending horizontal bars (5), as well as two or more bent bars (8) laid substantially at right angles to each other over the column end, each of said bent bars (8) running substantially along said bottom flexural reinforcement net (7) except at the columns where the bent bars run substantially along said top flexural reinforcement net (7'), characterized in that the longitudinally extending horizontal bars (5) of the stirrup cage arrangement (3,3') are disposed in a non-interlocking manner on top of the bottom flexural reinforcement net (7) and that said top flexural reinforcement net is disposed in a non-interlocking manner on top of the stirrup cage arrangement.

2. Concrete flat slab structure according to claim 1, characterized in that said stirrup cage arrangement is composed of a plurality of separate stirrup cages (3,3') composed of a series of U-shaped bars (4) connected in spaced relationship with each other by two longitudinally extending bars (5) fixed to the ends of the legs of each U-shaped bar (4).

3. Concrete flat slab structure according to claim 2, characterized in that said separate stirrup cages (3, 3') are oriented with their longitudinally extending bars (5) at or near the bottom flexural reinforcement net (7).

4. Concrete slab structure according to claim 3, characterized in that said separate stirrup cages (3, 3') are oriented in parallel with each other with short stirrup cages (3') approaching and terminating at the respective column (1).

5. Method of building a concrete slab structure supported horizontally on at least one substantially vertical column (1), said method comprising the following steps of:

a. laying in a form a bottom flexural reinforcement net (7);

b. placing, in areas (2) adjacent each column on either side thereof, in parallel rows, long stirrup cages (3,) each composed of a series of vertically oriented U-shaped bars (4) connected, in spaced relationship with each other, by two longitudinally extending bars (5) fixed to the ends of the legs of each U-shaped bar (4);

c. laying, at right angles to each other and crossing each other at the respective column, at least two bent bars (8), in such a way that each of said bars runs substantially along said bottom flexural reinforcement (7) except at the columns (1);

d. laying, on top of said stirrup cages and said bent bars, a top flexural reinforcement net (7');

e. pouring concrete in said form to a level above said top flexural reinforcement net (7') and allowing it to set.

6. Method according to claim 5, comprising the additional step of placing, in parallel with the long stirrup cages, short stirrup cages (3') terminating at the respective column (1).

7. Method according to claim 5 or 6, wherein the stirrup cages (3, 3') are placed so that their longitudinally extending bars (5) run along the bottom flexural reinforcement net (7).

* * * * *